United States Patent [19]

Honda et al.

[11] Patent Number: 4,590,985

[45] Date of Patent: May 27, 1986

[54] APPARATUS FOR HORIZONTALLY AND INTERMITTENTLY WITHDRAWING CAST STEEL STRAND FROM HORIZONTAL MOLD OF HORIZONTAL TYPE CONTINUOUS CASTING MACHINE

[75] Inventors: Akira Honda, Kamakura; Yasuo Yanagihashi, Tokyo; Shinobu Kumagai, Yokohama, all of Japan

[73] Assignee: Nippon Kokan Kabushiki Kaisha, Tokyo, Japan

[21] Appl. No.: 755,332

[22] PCT Filed: Oct. 30, 1984

[86] PCT No.: PCT/JP84/00525

§ 371 Date: Jun. 27, 1985

§ 102(e) Date: Jun. 27, 1985

[87] PCT Pub. No.: WO85/01900

PCT Pub. Date: May 9, 1985

[30] Foreign Application Priority Data

Oct. 31, 1983 [JP] Japan ..... 58-202682

[51] Int. Cl.[4] ..... B22D 11/04; B22D 11/128

[52] U.S. Cl. ..... 164/440; 164/442; 164/448; 164/484

[58] Field of Search ..... 164/440, 442, 448, 478, 164/484, 490, 413, 454

[56] References Cited

U.S. PATENT DOCUMENTS

| | | | |
|---|---|---|---|
| 3,540,523 | 11/1970 | Wertli | 164/440 |
| 3,669,176 | 6/1972 | Krall et al. | 164/440 X |
| 3,817,313 | 6/1974 | Gamble et al. | 164/478 |
| 4,513,806 | 4/1985 | Iida et al. | 164/440 X |

*Primary Examiner*—Nicholas P. Godici
*Assistant Examiner*—J. Reed Batten, Jr.
*Attorney, Agent, or Firm*—Frishauf, Holtz Goodman & Woodward

[57] ABSTRACT

An apparatus for horizontally and intermittently withdrawing a cast steel strand from a horizontal mold of a horizontal type continuous casting machine, which comprises: at least one pair of pinch rolls (2A, 2B; 3A, 3B) for horizontally and intermittently withdrawing the cast steel strand from the horizontal mold by a plurality of cycles each comprising one pull for a prescribed period, one pause for a prescribed period and one push for a prescribed period; a driving device (4) for driving the at least one pair of pinch rolls (2A, 2B; 3A, 3B) through a driving force transmitter (6) in response to the above-mentioned one pull, one pause and one push in each cycle; and a brake (12) for imparting to the driving device (4) a braking force proportional to the number of rotations of the driving device (4) during the prescribed period of the one pull in each cycle so as to prevent the cast steel strand from being pulled over the prescribed period of the one pull in each cycle, the braking force of the brake (12) being smaller than the driving force of the driving device (4).

3 Claims, 4 Drawing Figures

APPARATUS FOR HORIZONTALLY AND INTERMITTENTLY WITHDRAWING CAST STEEL STRAND FROM HORIZONTAL MOLD OF HORIZONTAL TYPE CONTINUOUS CASTING MACHINE

FIELD OF THE INVENTION

The present invention relates to an apparatus for horizontally and intermittently withdrawing a cast steel strand from a horizontal mold of a horizontal type continuous casting machine by means of a plurality of cycles each comprising one pull, one pause and one push.

BACKGROUND OF THE INVENTION

The horizontal type continuous casting machine has recently been industrialized for the urpose of manufacturing cast steel strands. In this machine, a cast steel strand is horizontally and intermittently withdrawn from a horizontal mold fitted to a lower portion of a side wall of a tundish with molten steel received therein by means of a plurality of cycles each comprising one pull, one pause and one push. More particularly, the cast steel strand is first pulled from the horizontal mold in the horizontal direction at a prescribed pulling speed for a prescribed pulling period of time, then the pulling of the cast steel strand is paused for a prescribed pausing period of time, and then the cast steel strand is pushed back in the direction opposite to the pulling direction for a prescribed pushing period of time. This push prevents the solidified shell of the cast steel strand from being broken in the horizontal mold under the effect of thermal contraction, which otherwise results in breakout.

Pulling of the cast steel strand is paused for the prescribed pausing period of time as described above for the purpose of increasing the thickness of the solidified shell of the cast steel strand in the horizontal mold prior to pushing back of the cast steel strand in the direction opposite to the pulling direction, and thus preventing the solidified shell from buckling during pushing back of the cast steel strand.

A conventional apparatus for horizontally and intermittently withdrawing a cast steel strand in the manner as described above from a horizontal mold of a horizontal type continuous casting machine comprises at least one pair of pinch rolls and a driving device. The at least one pair of pinch rolls horizontally and intermittently withdraws the cast steel strand from the horizontal mold by means of a plurality of cycles each comprising one pull for a prescribed period of time, one pause for a prescribed period of time and one push for a prescribed period of time, and the driving device drives the at least one pair of pinch rolls through a driving force transmitting means in response to the abovementioned one pull, one pause and one push in each cycle.

However, when the weight per unit length of the cast steel strand increases, the driving device does not stop at once but overshoots the prescribed limit even upon receiving an instruction signal to stop the pull of the cast steel strand, under the effect of inertia of the cast steel strand acting on the driving device. Consequently, the cast steel strand is pulled from the horizontal mold over the prescribed pulling period of time, causing not only deterioration of quality of the cast steel strand but also increasing risk of breakout.

During the push of the cast steel strand, since the cast steel strand is pushed back only slightly, the driving device never overshoots the prescribed limit under the effect of inertia of the cast steel strand as in the pull of the cast steel strand.

Under such circumstances, there is a demand for the development of an apparatus which permits an accurate pulling of a cast steel strand, which is manufactured by a horizontal type continuous casting machine, from a horizontal mold thereof without exceeding a prescribed pulling period of time even when the weight per unit length of the cast steel strand increases, but such an apparatus has not as yet been proposed.

SUMMARY OF THE INVENTION

An object of the present invention is therefore to provide an apparatus for horizontally and intermittently withdrawing a cast steel strand from a horizontal mold of a horizontal type continuous casting machine, which permits an accurate pulling of a cast steel strand, which is manufactured by a horizontal type continuous casting machine, from a horizontal mold thereof without exceeding a prescribed pulling period of time even when the weight per unit length of the cast steel strand increases.

In accordance with one of the features of the present invention, there is provided an apparatus for horizontally and intermittently withdrawing a cast steel strand from a horizontal mold of a horizontal type continuous casting machine, which comprises:

at least one pair of pinch rolls for horizontally and intermittently withdrawing with cast steel strand from said horizontal mold by means of a plurality of cycles each comprising one pull for a prescribed period of time, one pause for a prescribed period of time and one push for a prescribed period of time; and a driving device for driving said at least one pair of pinch rolls through a driving force transmitting means in response to said one pull, said one pause and said one push in each cycle;

characterized by comprising:

a braking means (12) for imparting to said driving device (4) a braking force proportional to the number of rotations of said driving device (4), during said prescribed period of time of said one pull in each cycle of said cast steel strand (1) from said horizontal mold by means of said at least one pair of pinch rolls (2A, 2B; 3A, 3B), to prevent said cast steel strand (1) from being pulled from said horizontal mold over said prescribed period of time of said one pull, said braking force of said braking means (12) being smaller than the driving force of said driving device (4), and said braking means (12) comprising:

an oil brake (13) which interlocks with said driving device (4) and rotates in the same direction as the rotating direction of said driving device (4);

an oil tank (14) for receiving brake oil for driving said oil brake (13);

two conduits (15, 16) which communicate said oil brake (13) to said oil tank (14), for introducing the brake oil in said oil tank (14) into said oil brake (13) in response to the number of rotations of said oil brake (13) and feeding the brake oil thus introduced into said oil brake (13) back to said oil tank (14) from said oil brake (13);

a throttle valve (17) provided in the middle of one of said two conduits (15, 16); and a check valve (18), which opens only during said prescribed period of time of said one push in each cycle of said cast steel strand (1), provided in parallel with said throttle valve (17) in the middle of said one of said two conduits (15, 16).

BRIEF DESCRIPTON OF THE DRAWINGS

DETAILED DESCRIPTION OF PREFERRED EMBODIMENTS

From the above-mentioned point of view, we carried out extensive studies to develop an apparatus which permits an accurate pulling of a cast steel strand, which is manufactured by a horizontal type continuous casting machine, from a horizontal mold thereof without exceeding a prescribed pulling period of time even when the weight per unit length of the cast steel strand increases.

As a result, we obtained a finding that it is possible to prevent the cast steel strand from being pulled from the horizontal mold over a prescribed pulling period of time, by imparting, to a driving device for driving at least one pair of pinch rolls, a braking force proportional to the number of rotations of the driving device while the cast steel strand is being horizontally pulled from the horizontal mold by means of the at least one pair of pinch rolls drivn by the driving device.

The present invention was made on the basis of the above-mentioned finding. Now, a first embodiment of the apparatus of the present invention is described with reference to the drawings.

Figure 1:
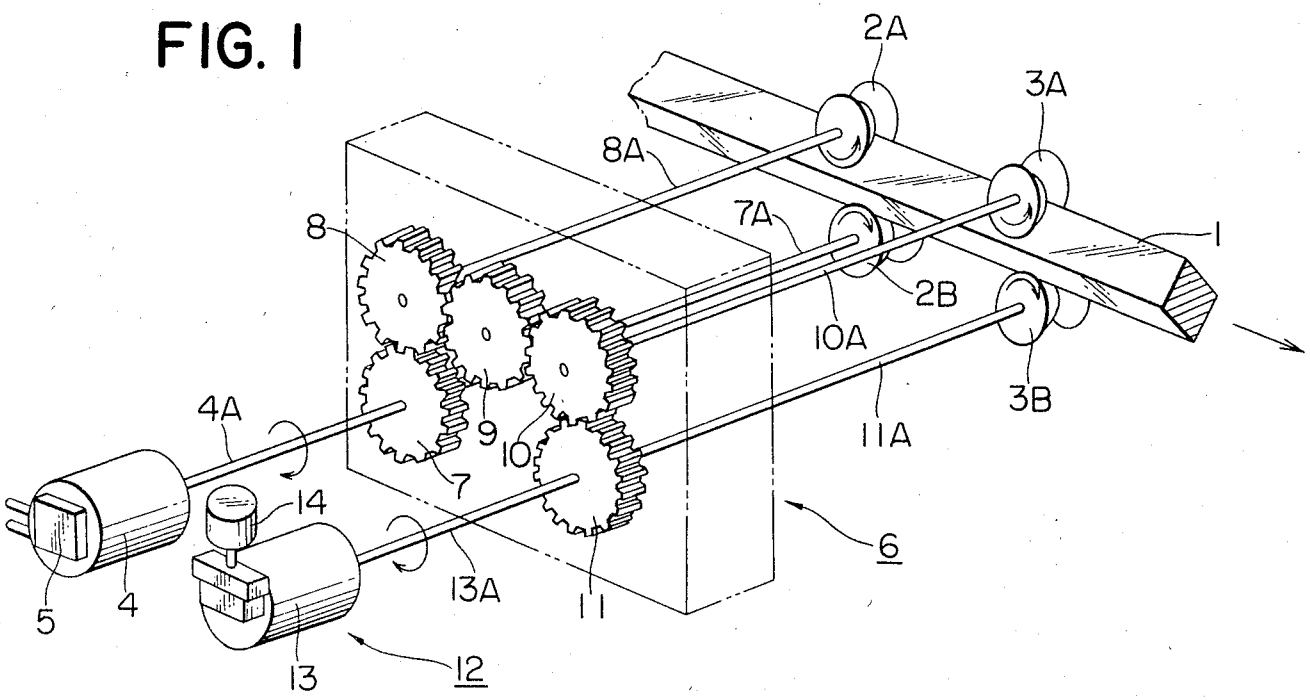
FIG. 1 is a schematic perspective view illustrating a state in which a cast steel strand is withdrawn from a horizontal mold of a horizontal type continuous casting machine according to a first embodiment of the apparatus of the present invention.

FIG. 1 is a schematic perspective view illustrating a state in which a cast steel strand is withdrawn from a horizontal mold of a horizontal type continuous casting machine according to a first embodiment of the apparatus of the present invention.

As shown in FIG. 1, a first pair of pinch rolls 2A, 2B and a second pair of pinch rolls 3A, 3B which is spaced apart from the first pair of pinch rolls 2A, 2B, are driven by a driving device described later to horizontally and intermittently withdraw a cast steel strand 1 from a horizontal mold (not shown) of a horizontal type continuous casting machine (also not shown) by means of a plurality of cycles each comprising one pull for a prescribed period of time, one pause for a prescribed period of time and one push for a prescribed period of time.

The drive device 4 comprises an oil motor provided with a servo valve 5 and drives the first pair of pinch rolls 2A, 2B and the second pair of pinch rolls 3A, 3B through a driving force transmitting means described later. The servo valve 5 controls the number of rotations of the above-mentioned oil motor so that the cast steel strand 1 is intermittently withdrawn from the horizontal mold by means of the above-mentioned plurality of cycles each comprising one pull, one pause and one push. An electric motor may be used in place of the oil motor as the driving device 4.

The driving force transmitting means 6 comprises a driving gear 7 fixed to a rotating shaft 4A of the driving device 4, and a first driven gear 8, a second driven gear 10, a third driven gear 11 and an idle gear 9 which are driven by the driving gear 7. The first driven gear 8 engages with both the driving gear 7 and the idle gear 9, and the second driven gear 10 engages with both the idle gear 9 and the third driven gear 11. A rotating shaft 8A of the first driven gear 8 is fixed to the upper pinch roll 2A of the first pair of pinch rolls 2A, 2B. A rotating shaft 7A of the driving gear 7 is fixed to the lower pinch roll 2B of the first pair of pinch rolls 2A, 2B. A rotating shaft 10A of the second driven gear 10 is fixed to the upper pinch roll 3A of the second pair of pinch rolls 3A, 3B. A rotating shaft 11A of the third driven gear 11 is fixed to the lower pinch roll 3B of the second pair of pinch rolls 3A, 3B.

Since the first pair of pinch rolls 2A, 2B and the second pair of pinch rolls 3A, 3B are connected to the driving device 4 through the driving force transmitting means 6 as described above, the first pair of pinch rolls 2A, 2B is driven by the driving device 4 through the driving gear 7 and the first driven gear 8, and the second pair of pinch rolls 3A, 3B is driven by the driving device 4 through the driving gear 7, the first driven gear 8, the idle gear 9, the second driven gear 10 and the third driven gear 11.

Figure 2:
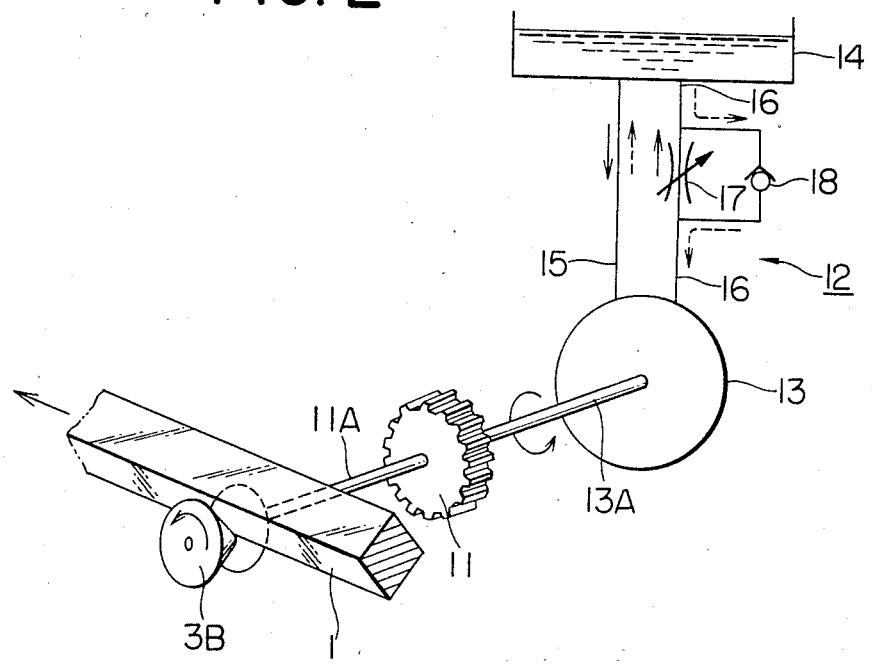
FIG. 2 is a descriptive view illustrating the principle of a braking means which is used in the apparatus of the present invention.

As shown in FIG. 2, a braking means 12 comprises an oil brake 13, an oil tank 14 for receiving brake oil for driving the oil brake 13, two conduits 15, 16 for communicating the oil brake 13 to the oil tank 14, a flow-adjustable throttle valve 17 provided in the middle of the conduit 16 of the two conduits 15, 16, and a check valve 18, which opens only while the cast steel strand 1 is pushed back, provided in parallel with the throttle valve 17 in the middle of the conduit 16.

Figure 3:
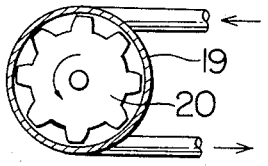
FIG. 3 is a sectional view illustrating the principle of a conventionally known oil motor which is used in the apparatus of the present invention.

The oil brake 13 comprises, as shown in FIG. 3, for example, a conventionally known oil motor which comprises an impeller 20 housed in a casing 19 and in which the impeller 20 is rotated by pressure-feeding brake oil into the casing 19. As shown in FIGS. 1 and 2, a rotating shaft 13A of the oil brake 13 is fixed to the third driven gear 11 of the driving force transmitting means 6. Thus, the oil brake 13 is driven by the driving device 4 in the same direction as the rotating direction of the driving device 4 through the driving gear 7, the first driven gear 8, the idle gear 9, the second driven gear 10 and the third driven gear 11 of the driving force transmitting means 6. As is clear from the foregoing, the driving device 4, the first and the second pairs of pinch rolls 2A, 2B; 3A, 3B and the oil brake 13 are interlocked with each other through the driving force transmitting means 6.

The two conduits 15, 16 introduce brake oil in the oil tank 14 into the oil brake 13 in response to the number of the rotations of the oil brake 13, and feed the brake oil thus introduced into the oil brake 13 back to the oil tank 14 from the oil brake 13.

The throttle valve 17 restricts the flow rate of the brake oil flowing out from the oil brake 13, while the cast steel strand 1 is pulled from the horizontal mold, under the effect of the check valve 18 provided in parallel with the throttle valve 17. This produces a braking force proportional to the number of rotations of the driving device 4 in the oil brake 13 while the cast steel strand 1 is pulled from the horizontal mold. The braking force of the oil brake 13 is imparted to the driving device 4 through the driving force transmitting means 6. This braking force is smaller than the driving force of the driving device 4.

In the above-mentioned first embodiment of the apparatus of the present invention, when an instruction signal to start the pull of the cast steel strand 1 is given to the driving device 4, the first pair of pinch rolls 2A, 2B and the second pair of pinch rolls 3A, 3B are rotated by the driving device 4 through the driving force transmitting means 6 in the arrow direction shown in FIG. 1. The cast steel strand 1 is thus applied from the horizontal mold in the arrow direction in FIG. 1 at a prescribed pulling speed for a prescribed pulling period of time, for example, for 0.25 second. During this period of time, the oil brake 13 rotates in the same direction as the rotating direction of the driving device 4 through the driving force transmitting means 6. The brake oil in the oil tank 14 is therefore introduced into the oil brake 13 through the conduit 15 as shown by the solid arrow in FIG. 2, and is fed back to the oil tank 14 from the oil brake 13 through the throttle valve 17 provided in the middle of the conduit 16. Since the throttle valve 17 restricts the flow rate of the brake oil flowing out from the oil brake 13 as described above, a braking force proportional to the number of rotations of the driving device 4 is produced in the oil brake 13.

Upon receiving an instruction signal to stop the pull of the cast steel strand 1, the driving device 4 loses the drive force thereof, whereas a rotating force in the pulling direction of the cast steel strand 1 acts on the driving device 4 under the effect of inertia of the cast steel strand 1. However, since the oil brake 13 interlocking with the driving device 4 continues to impart to the driving device 4 a braking force proportional to the number of rotations of the driving device 4, the driving device 4 instantly stops almost without overshooting. The cast steel strand 1 is thus accurately pulled from the horizontal mold without exceeding the prescribed pulling period of time.

When, after the pause of pull of the cast steel strand 1 for a prescribed pausing period of time, for example, for 0.1 second, an instruction signal to push back the cast steel strand 1 is given to the driving device 4, the first pair of pinch rolls 2A, 2B and the second pair of pinch rolls 3A, 3B are slightly rotated in the direction opposite to the pulling direction of the cast steel strand 1 by the driving device 4 through the driving force transmitting means 6. The cast steel strand 1 is thus pushed back in the direction opposite to the pulling direction for a prescribed pushing period of time, for example, for 0.15 second. In the meantime, the oil brake 13 slightly rotates in the same direction as the rotating direction of the driving device 4 through the driving force transmitting means 6. As a result, the brake oil in the oil tank 14 is introduced into the oil brake 13 through the check valve 18 provided in the middle of the conduit 16 as shown by the dotted-line arrow in FIG. 2, and is freely fed back to the oil tank 14 from the oil brake 13 through the conduit 15 as shown by the dotted-line arrow in FIG. 2. Thus, almost no braking force is produced in the oil brake 13 during the push of the cast steel strand 1, but since the cast steel strand 1 is pushed back only slightly, the driving device 4 never overshoots the prescribed limit under the effect of inertia of the cast steel strand 1 as in the pull of the cast steel strand 1.

In this manner described above, the cast steel strnd 1 is horizontally and intermittently withdrawn from the horizontal mold by the first pair of pinch rolls 2A, 2B and the second pair of pinch rolls 3A, 3B by means of a plurality of cycles each comprising one pull for a prescribed period of time, one pause for a prescribed period of time and one push for a prescribed period of time.

Now, a second embodiment of the apparatus of the present invention is described with reference to the drawing.

Figure 4:
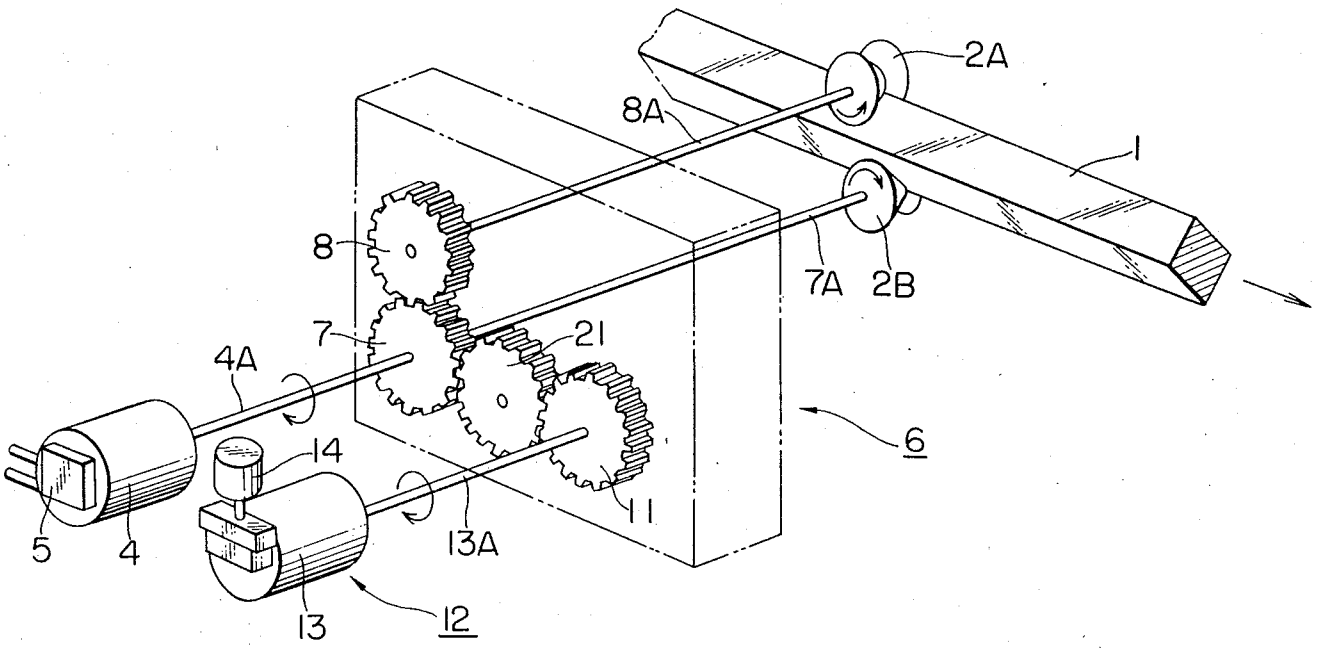
FIG. 4 is a schematic perspective view illustrating a state in which a cast steel strand is withdrawn from a horizontal mold of a horizontal type continuous casting machine according to a second embodiment of the apparatus of the present invention.

FIG. 4 is a schematic perspective view illustrating a state in which a cast steel strand is withdrawn from a horizontal mold of a horizontal type continuous casting machine according to a second embodiment of the apparatus of the present invention.

As shown in FIG. 4, a pair of pinch rolls 2A, 2B is driven by a driving device described later to horizontally and intermittently withdraw a cast steel strand 1 from a horizontal mold (not shown) of a horizontal type continuous casting machine (also not shown) by means of a plurality of cycles each comprising one pull for a prescribed period of time, one pause for a prescribed period of time and one push for a prescribed period of time.

The driving device 4 comprises an oil motor provided with a servo valve 5, and drives the pair of pinch rolls 2A, 2B through a driving force transmitting means described later. The servo valve 5 controls the number of rotations of the oil motor so that the cast steel strand 1 is intermittently withdrawn from the horizontal mold by means of the above-mentioned plurality of cycles each comprising one pull, one pause and one push. An electric motor may be used in place of the oil motor as the driving device 4.

The driving force transmitting means 6 comprises a driving gear 7 fixed to a rotating shaft 4A of the driving device 4, and a first driven gear 8, an idle gear 21 and a third driven gear 11 which are driven by the driving gear 7. The first driven gear 8 engages with the driving gear 7, and the idle ger 21 engages with both the driving gear 7 and the third given ger 11. A rotating shaft 8A of the first driven gear 8 is fixed to the upper pinch roll 2A of the pair of pinch rolls 2A, 2B. A rotating shaft 7A of the driving ger 7 is fixed to the lower pinch roll 2B of the pair of pinch rolls 2A, 2B.

A braking means 12 has the same structure and function as in the first embodiment of the apparatus of the present invention. A rotating shaft 13A of an oil brake 13 in the braking means 12 is fixed to the third driven gear 11 of the driving force transmitting means 6.

As described above, since the pair of pinch rolls 2A, 2B, the oil brake 13 and the driving device 4 are interlocked with each other through the driving force transmitting means 6, the pair of pinch rolls 2A, 2B is driven by the driving device 4 through the driving gear 7 and the first driven gear 8, and the oil brake 13 is driven by the driving device 4 in the same direction as the rotating direction of the driving device 4 through the driving gear 7, the idle gear 21 and the third driven gear 11.

In the above-mentioned second embodiment of the appartus of the present invention, the cast steel strand 1 is horizontally and intermittently withdrawn from the horizontal mold, as in the above-mentioned first embodiment of the apparatus of the present invention, by the pair of pinch rolls 2A, 2B, by means of a plurality of cycles each comprising one pull for a prescribed period of time, one pause for a prescribed period of time and one push for a prescribed period of time.

According to the apparatus of the present invention, as described above in detail, it is possible to accurately pull a cast steel strand, which is manufactured by a horizontal type continuous casting machine, from a horizontal mold thereof without exceeding a prescribed pulling period of time even when the weight per unit length of the cast steel strand increases, and thus to manufacture a cast steel strand with excellent quality, thus providing industrially very useful effects.

What is claimed is:

1. In an apparatus for horizontally and intermittently withdrawing a cast steel strand from a horizontal mold of a horizontal type continuous casting machine, which comprises:

at least one pair of pinch rolls for horizontally and intermittently withdrawing said cast steel strand from said horizontal mold by means of a plurality of cycles each comprising one pull for a prescribed period of time, one pause for a prescribed period of time and one push for a prescribed period of time; and a driving device for driving said at least one pair of pinch rolls through a driving force transmitting means in response to said one pull, said one pause and said one push in each cycle;

the improvement comprising:

a braking means (12) for imparting to said driving device (4) a braking force proportional to the number of rotations of said driving device (4), during said prescribed period of time of said one pull in each cycle of said cast steel strand (1) from said horizontal mold by means of said at least one pair of pinch rolls (2A, 2B; 3A, 3B), to prevent said cast steel strand (1) from being pulled from said horizontal mold over said prescribed period of time of said one pull, said braking force of said braking means (12) being smaller than the driving force of said driving device (4), and said braking means (12) comprising:

an oil brake (13) which interlocks with said driving device (4) and rotates in the same direction as the rotating direction of said driving device (4);

an oil tank (14) for receiving brake oil for driving said oil brake (13);

two conduits (15, 16), which communicate said oil brake (13) to said oil tank (14), for introducing the brake oil in said oil tank (14) into said oil brake (13) in response to the number of rotations of said oil brake (13) and feeding the brake oil thus introduced into said oil brake (13) back to said oil tank (14) from said oil brake (13);

a throttle valve (17) provided in the middle of one of said two conduits (15, 16); and a check valve (18), which opens only during said prescribed period of time of said one push in each cycle of said cast steel strand (1), provided in parallel with said throttle valve (17) in the middle of said one of said two conduits (15, 16).

2. The apparatus as claimed in claim 1, wherein:

said at least one pair of pinch rolls comprises a first pair of pinch rolls (2A, 2B) and a second pair of pinch rolls (3A, 3B), said first pair of pinch rolls (2A, 2B) being driven by said driving device (4) through a driving gear (7) and a first driven gear (8) as said driving force transmitting means (6), and said second pair of pinch rolls (3A, 3B) and said oil brake (13) being driven by said driving device (4) through said driving gear (7), said first driven gear (8), an idle gear (9), a second driven gear (10) and a third driven gear (11) as said driving force transmitting means (6).

3. The apparatus as claimed in claim 1, wherein:

said at least one pair of pinch rolls comprises one pair of pinch rolls (2A, 2B), said one pair of pinch rolls being driven by said driving device (4) through a driving gear (7) and a first driven gear (8), and said oil brake (13) being driven by said driving device (4) through said driving gear (7), an idle gear (21) and a third driven gear (11) as said driving force transmitting means (6).

* * * * *